US006168743B1

(12) United States Patent
Reese et al.

(10) Patent No.: US 6,168,743 B1
(45) Date of Patent: Jan. 2, 2001

(54) METHOD OF CONTINUOUSLY HEAT TREATING ARTICLES AND APPARATUS THEREFOR

(75) Inventors: Glen Patrick Reese; James Richard Goodall, both of Charlotte, NC (US)

(73) Assignee: Arteva North America S.A.R.L., Zurich (CH)

( * ) Notice: Under 35 U.S.C. 154(b), the term of this patent shall be extended for 0 days.

(21) Appl. No.: 09/334,140

(22) Filed: Jun. 15, 1999

(51) Int. Cl.[7] ..... D01D 10/02; D02J 13/00

(52) U.S. Cl. ..... 264/345; 28/219; 28/247; 28/273; 34/448; 34/451; 34/459; 34/629; 34/632; 34/636; 68/5 E; 425/445

(58) Field of Search ..... 264/345; 425/445; 28/219, 247, 273; 34/448, 451, 459, 629, 632, 636; 68/5 E

(56) References Cited

U.S. PATENT DOCUMENTS

| | | |
|---|---|---|
| 3,452,132 | 6/1969 | Pitzl . |
| 4,639,347 | 1/1987 | Hancock et al. . |
| 4,704,329 | 11/1987 | Hancock et al. . |
| 5,287,606 | 2/1994 | Reuf . |

FOREIGN PATENT DOCUMENTS

| | | |
|---|---|---|
| 195 46 783 C1 | 7/1997 | (DE) . |

*Primary Examiner*—Leo B. Tentoni
(74) *Attorney, Agent, or Firm*—Gregory N. Clements

(57) ABSTRACT

A method and apparatus for steam-treating yarn, films, fibers, fiber tow and other polymeric articles is described. The apparatus includes a first orifice for generating minimum pressure areas and a second orifice to provide a sonic shock region operative to isolate the pressure in one chamber from the pressure in another chamber.

20 Claims, 3 Drawing Sheets

METHOD OF CONTINUOUSLY HEAT TREATING ARTICLES AND APPARATUS THEREFOR

TECHNICAL FIELD

The present invention relates generally to a method of continuously heat-treating articles of manufacture. In a preferred embodiment, polyethylene terephthalate fiber is treated with saturated steam at elevated pressures. In another aspect, the invention is directed to a self-sealing pressure apparatus for continuously heat-treating articles with saturated vapor.

BACKGROUND

Heat treatment by way of high pressure vapor application is known in the art. In particular, annealing polyester filaments is described in U.S. Pat. Nos. 4,704,329 and 4,639,347 of Hancock et al. by utilizing saturated steam. See, also related European Patent No. 0 125 112 which contains substantially the same disclosure. U.S. Pat. No. 5,287,606 to Ruef describes an apparatus for steam-treating textile filaments, which apparatus includes a plurality of chambers. As can be seen from FIG. 1 of the '606 patent the upstream and downstream serially arranged chambers serve to maintain pressure in the treatment chamber. Note column 7, lines 25–31.

Yet another steam treatment device is described in German Patent Specification DE 195 46 783 C1, in most detail in connection with FIG. 4 thereof. The device disclosed in the '783 document includes an expansion nozzle feeding a treatment channel wherein the steam accelerates to supersonic speed. The steam decelerates to subsonic speed in the treatment chamber before encountering a second nozzle which again accelerates the steam to supersonic velocity.

Another method for steam-treating polyester fibers is disclosed in U.S. Pat. No. 3,452,132 to Pitzl, wherein a method of heat-treating polyethylene terephthalate yarn by applying a steam jet thereto is described.

There is provided in accordance with the present invention an improved method of heat-treating articles with saturated vapor as described below.

SUMMARY OF THE INVENTION

In a first aspect, the present invention is directed to a method of heat-treating an article of manufacture including supplying a heated vapor medium at elevated pressure to a vapor expansion chamber through a first nozzle. The nozzle cooperates with the expansion chamber to generate a high velocity flow and establishes regions of reduced pressure therein. The article is continuously fed to the expansion chamber through a feed orifice located within one of the established regions of low pressure. The article is then conveyed through a sonic shock region to a treatment chamber, the shock region being operative to isolate the pressure of said treatment chamber from the expansion chamber.

Most preferably, the high velocity flow generated in the expansion chamber is a supersonic flow and the feed orifice is defined by a conduit, the orifice being at about the point of minimum pressure in the expansion chamber. The conduit typically defines an entrance external to the expansion chamber.

In a cascaded process to stepwise control the pressure in the treatment chamber, a further step is to provide a heated vapor medium through a second nozzle to the treatment chamber.

The inventive method is suitable for treating a variety of articles. Discrete articles such as pellets may be continuously fed by way of a suitable conveyor. Most typically, the process is applied to continuous shaped articles fed from a roll or equivalent; such as films, fibers, fiber tow, ropes, fabrics and yarns. In most cases, polymeric articles are treated, such as shaped articles of polyethylene terephthalate. The heated vapor medium is typically steam and the process is operated so that the steam is saturated steam in the treatment chamber. The steam may be superheated or saturated as fed to the first nozzle.

Typically, the heated vapor medium exits the treatment chamber through a third nozzle.

In an alternate embodiment of this inventive process, the articles may be fed through a sonic shock region to a region of low pressure generated by the heated vapor medium to a low pressure treatment region. Generally, this process is practiced with the same or similar equipment and includes supplying a heated vapor medium at elevated pressure through a first nozzle into an expansion chamber to establish a region of low pressure, venting the vapor medium through a second nozzle operative to create a sonic shock region which isolates the downstream pressure from the pressure in the expansion chamber and continuously feeding the article to be treated through the sonic shock region, to the low pressure region in the expansion chamber and into a low pressure treatment chamber.

In a further aspect, the present invention is directed to an apparatus for vapor treating articles of manufacture. The apparatus includes a means for providing a supply of a heated vapor medium at elevated pressure, a vapor expansion chamber and a first nozzle coupling the two. The first nozzle is capable of cooperating with the expansion chamber to generate a high velocity flow of the vapor medium, which, in turn establishes low pressure regions within the expansion chamber. The articles to be vapor treated are introduced into a low pressure region within the expansion chamber through a feed orifice.

The vapor expansion chamber is coupled to a treatment chamber through a second nozzle operative to maintain a sonic shock which isolates the pressure in the expansion chamber from the pressure in the treatment chamber.

Preferably, the apparatus further includes a feed conduit with a port positioned at about the point of minimum pressure in the expansion chamber and a second port external to the expansion chamber. So also, the high velocity flow in the expansion chamber is preferably a supersonic flow.

The second nozzle may also be coupled to a source of heated vapor medium at elevated pressure if it is desired to stepwise control the pressure of the system.

The apparatus in accordance with the invention is advantageously fitted with a downstream sealing device including a third nozzle, a sump coupled to the treatment chamber by way of the third nozzle and exit ports within the sump. The sump is maintained at about atmospheric pressure by means of exhaust channels which divert the flow to a waste or recycle region. The channels are large enough to maintain the flow without a large pressure drop. The exhaust flow rate is limited by the third nozzle, which chokes the flow to make it independent of the sump pressure.

The apparatus is preferably formed of stainless steel, a performance alloy or other wear resistant, non-corroding material.

In a still further aspect of the invention, there is provided a multi-stage apparatus for cascading the pressure used to vapor treat shaped articles. Such apparatus includes: (a)

means for supplying a first supply of a heated vapor medium at elevated pressure; (b) a first vapor expansion chamber; (c) a first nozzle coupling the means for supplying the first supply of heated vapor medium with the first expansion chamber, first nozzle being capable of cooperating with said first expansion chamber to generate a supersonic flow of vapor medium in the first expansion chamber and generate a pressure minimum within the chamber; (d) a first feed orifice positioned, configured and dimensioned to introduce articles of manufacture into the first expansion chamber at a zone of reduced pressure; (e) means for supplying a second supply of a heated vapor medium at elevated pressure; (f) a second vapor expansion chamber; (g) a second nozzle coupling the second supply of heated vapor medium with the second vapor expansion chamber, the second nozzle being capable of cooperating with the second expansion chamber to generate a supersonic flow of vapor medium within the second vapor expansion chamber and generate a pressure minimum within the second chamber; (h) a second feed orifice positioned, configured and dimensioned to introduce articles of manufacture into the second expansion chamber at a zone of reduced pressure; (i) a third means for supplying a heated vapor medium at an elevated pressure; (j) a treatment chamber; (k) a third nozzle coupling the third means for supplying heated vapor medium to the treatment chamber, the third nozzle being capable of maintaining a sonic shock wave operative to isolate the pressure of the treatment chamber from the second vapor expansion chamber; and (l) a third feed orifice for introducing articles into the treatment chamber.

BRIEF DESCRIPTION OF DRAWINGS

The present invention is described in detail below by reference to numerous examples and figures. In the drawings:

FIG. 1(*b*) is a plot of pressure vs. distance along the length of the apparatus of FIG. 1(*a*) wherein the pressure corresponds to the location of the apparatus appearing directly above;

FIG. 3(*b*) is a representation of a pressure profile along the length of the apparatus of FIG. 3(*a*) appearing directly above.

DETAILED DESCRIPTION

The invention is described in various embodiments below for purposes of illustration only. The spirit and scope of the present invention is set forth in the appended claims.

Figure 1A:
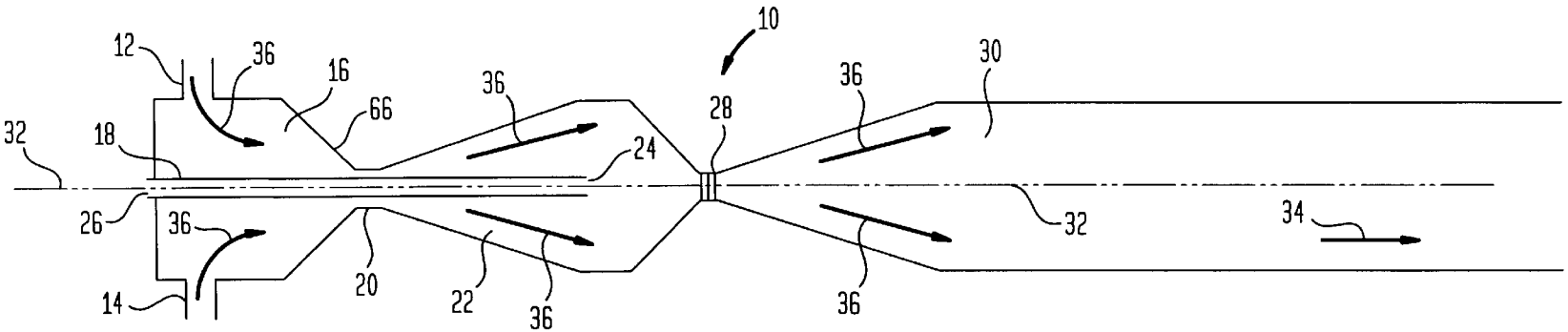
FIG. 1(*a*) is a schematic diagram illustrating an apparatus and processing method according to the present invention.
Figure 1B:
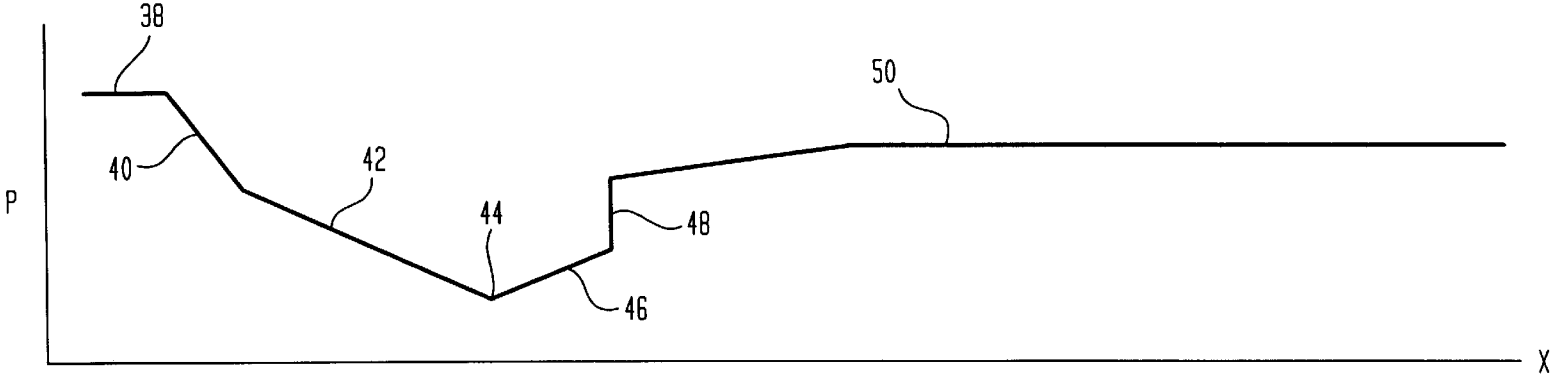

There is shown in FIG. 1(*a*) a schematic diagram of the inventive apparatus 10. Apparatus 10 includes 2 high pressure steam inlets 12, 14 communicating with an inlet plenum 16. A feed conduit 18 is centrally located in plenum 16 and extends therethrough. A first nozzle 20 couples plenum 16 with an expansion chamber 22 where there is an outlet 24 of feed conduit 18. Another outlet 26 of conduit 18 is located externally to the plenum 16. Downstream of expansion chamber 22 there is located a second nozzle 28 which communicates with a treatment chamber 30.

The apparatus 10 is generally operated to vapor treat a yarn indicated at 32 as follows: yarn 32 is continuously fed to outlet 26 of conduit 18 from the surroundings, typically at ambient conditions and conveyed through apparatus 10 in the direction indicated by arrow 34. Conduit 18 isolates the yarn from the environment of plenum 16 and introduces the yarn into expansion chamber 22 at outlet 24. Steam at elevated pressure at, for example, 250 psia is fed through inlets 12, 14 to plenum 16 and flows in the direction indicated by arrows 36. The steam then flows through first nozzle 20 and accelerates to high velocity, preferably supersonic velocity, in expansion chamber 22. Following acceleration in the expansion chamber, the steam encounters second nozzle 28 which is operative to establish and maintain a sonic shock wave effective to isolate the pressure in expansion chamber 22 from the pressure in treatment chamber 30, as is illustrated in FIG. 1(*b*) which is a plot of pressure, P, along the central axis, X, of apparatus 10 at points directly above on diagram 1(*a*). As the steam accelerates through the nozzle 20, the pressure drops as indicated at 40 as would be expected since the first step of the invention process is substantially an adiabatic expansion step. At nozzle 20 the steam is at sonic speed. The steam continues to accelerate to supersonic speeds in the expansion chamber as shown at 42 until it reaches a minimum pressure at 44 for example 25 psia depending on Mach number. Most preferably, outlet 24 of conduit 18 is located at this point of minimum pressure within chamber 22.

Following the point of minimum pressure, the steam begins to decelerate and the pressure in chamber 22 downstream of nozzle 20 begins to rise at 46 before encountering nozzle 28, which further decelerates this steam to a subsonic velocity and creates a sonic shock wave operative to isolate the pressure in treatment chamber 30 from the pressure in expansion chamber 22 as shown at 48.

In chamber 30 the pressure rises as a consequence of the lower velocity as seen at 50 to a stable value, for example 150 psia.

Figure 2:
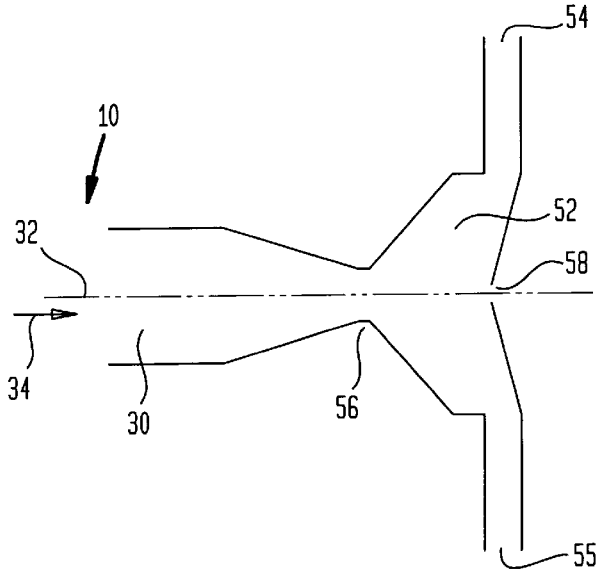
FIG. 2 is a schematic diagram of a downstream sealing device useful in connection with the apparatus of FIG. 1(*a*)

There is shown in FIG. 2 a downstream section of inventive apparatus 10, wherein like parts are numbered as in FIGS. 1(*a*) and 1(*b*). Treatment chamber 30 is coupled to a sump 52 as shown by way of a third nozzle 56. Sump 52 is also provided with an exit port 58, and exhaust ports 54 and 55.

In operation, yarn 32 is conveyed centrally along the apparatus together with the steam. The steam accelerates through nozzle 56 and attains sonic speed within the nozzle wherein its pressure drops to roughly one-half of the treatment pressure. The sump is maintained at about atmospheric pressure by the exit ports 55 and 54 so steam pressure continues to decrease after nozzle 56. The steam flow rate is choked by nozzle 56, so it becomes independent of the sump pressure. Exit port 58 is located at a high velocity/low pressure region of the steam created by the flow through nozzle 56. The yarn exits apparatus 10 through port 58, with a minimum of leakage to the surroundings through port 58.

The steam exiting through exhaust ports 54 and 55 may be collected and recycled or condensed.

The inventive apparatus may be fabricated in a variety of ways, from a variety of materials, depending upon the intended service conditions. For example, all portions of the apparatus could be fabricated in portions and then threaded together (not shown). Suitable materials of construction include stainless steel, performance alloys, and any wear resistant, non-corrodible material.

Likewise, the apparatus may be employed as described above under a variety of conditions. The apparatus is useful for very rapid non-contact heating or generating very large velocity flows parallel or counter to the direction of yarn conveyance therethrough. Application may include space heating for drawing yarn, heating for relaxation of technical yarns, drawing and heat setting of staple tows or space heating of yarn in a single step draw-spin process.

Typical conditions may include a steam inlet pressure to plenum 16 of 75 psia or so, accelerating to a velocity of 26,000 meters per minute through the first nozzle and 43,000 meters per minute in the expansion chamber. The pressure at outlet 24 could be maintained at roughly 0 psig pressure. Alternatively, one could operate the device to have a positive pressure at 26 so as to strip out incoming air. Typically, velocities in the treatment chamber would be well below those in the expansion chamber. From the principles of compressible flow, it is possible to calculate pressures, velocities, and temperatures in the various portions of the device, for various geometries of interest.

With the inventive apparatus it is possible to obtain treatment pressures of up to about 5 times ambient pressure with no, or very little, steam leakage from the apparatus, i.e. compression ratios of about 5:1. With higher supply pressures, positive back pressure will result in minor steam losses at entrance 26, but these losses are much smaller than would be suffered in the absence of the inventive device. With such high compression ratios, however, there is permanent pressure loss incurred in the shock wave, so that supply pressures must be considerably higher than the desired treatment pressure.

If one desires to operate at much higher treatment pressures than are practically achievable in the tube with 5:1 compression, with minimal steam leakage, then it is possible to cascade two or more such devices in multiple stages of compression as is discussed below.

There is shown schematically in FIG. 3(*a*) a three stage apparatus 110 and below it in FIG. 3(*b*) a pressure profile along the treatment path of apparatus 110. Parts or pressures similar to those described in connection with apparatus 10 are numbered 100, 200 or 300 numerals higher in FIGS. 3(*a*) and 3(*b*) where convenient for purposes of brevity. Apparatus 110 includes a pair of first stage steam inlets 112, 114 and an inlet 126 for the yarn to be treated which is fed to expansion chamber 122 through an outlet 124 and a first nozzle 120. A shock forms at nozzle 128, and high pressure steam is present in chamber 130. Excess steam is exhausted from chamber 130 through ports 113, 115 as shown by arrows 117.

Chamber 130 is coupled by way of a feed orifice 226 to a second expansion chamber 222 which includes another pair of steam inlets 212, 214 which feeds into chamber 222. It is intended that the pressures in chambers 130 and 222 ordinarily be similar. Chamber 222, in turn, is coupled to a higher pressure chamber 230 by way of nozzle 228, where a second shock wave stands. The process is repeated as the yarn leaves high pressure chamber 230 by way of orifice 326 to supersonic region 322, through shock wave nozzle 328 and into treatment chamber 330 at very high pressure. Chamber 330 is fed with high pressure steam from inlets 312, 314. The nozzles and orifices coupling the chambers may be annularly concentric or of any suitable geometry.

Apparatus 110 is operated generally as described in connection with FIG. 1(*a*) and FIG. 1(*b*), except that steam is fed at more than one point to upwardly cascade the pressure of the apparatus as is illustrated in connection with FIG. 3(*b*). For cascaded devices it may be beneficial to use lower compression ratios than are used in the single stage devices. One advantage is that there is less permanent pressure loss, so that supply pressure requirements can be less. An example of a cascaded device with 3:1 pressure ratios follows.

Figure 3A:
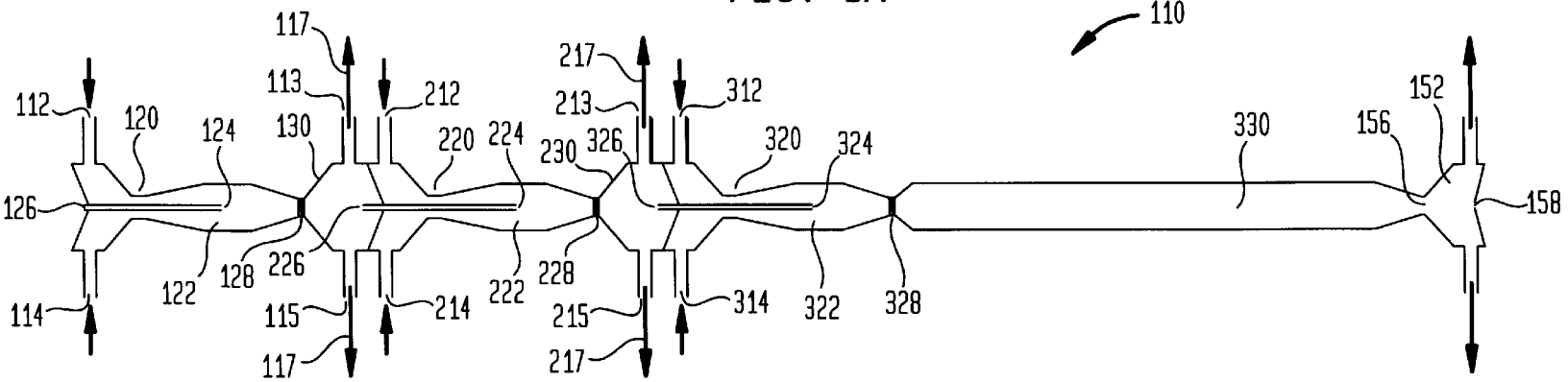
FIG. 3(*a*) is a schematic diagram illustrating a multi-stage apparatus constructed in accordance with the present invention.
Figure 3B:
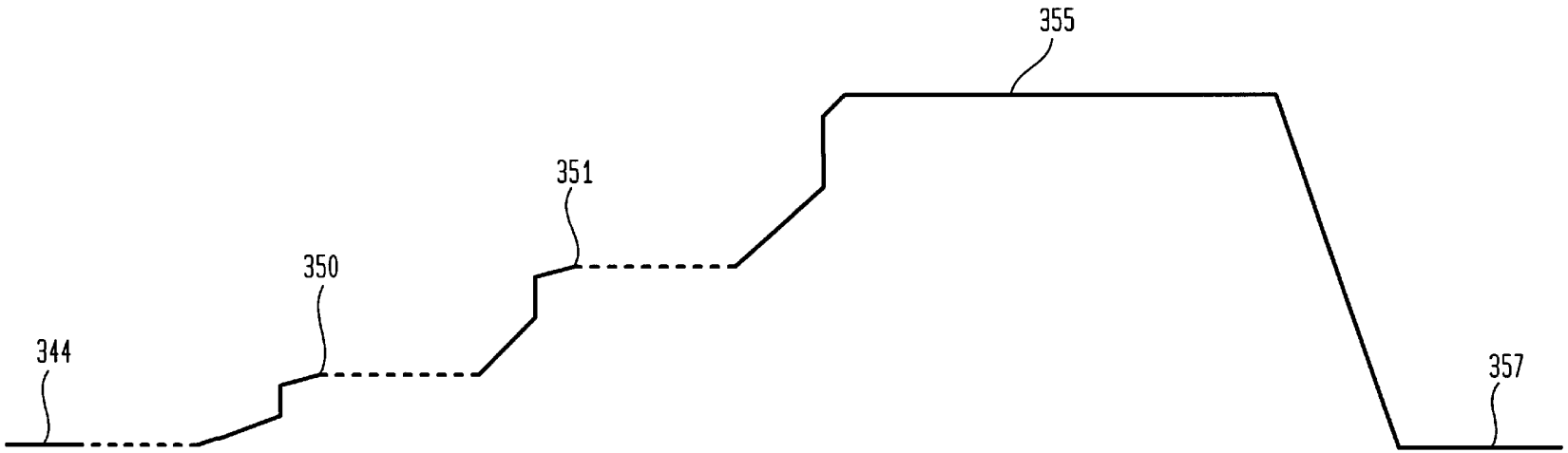

On FIG. 3(*b*), ambient pressure is indicated generally at 344. Outlet 124 is approximately at atmospheric pressure, while steam is supplied through inlets 112, 114 at 50 psia or so. The pressure in chamber 130 will thus rise to 45 psia or more as indicated at 350 on FIG. 3(*b*). Yarn is fed from chamber 130 to chamber 222 through orifice 226 and nozzle 220. Nozzle 220 is coupled to another supply of steam at a higher pressure by way of inlets 212, 214 at about 150 psia. The pressure thus rises after shock nozzle 228 to about 135 psia or so as indicated at 351 on FIG. 3(*b*). Excess steam may be exhausted through ports 213, 215 if so desired as shown by arrows 217. The yarn is then fed through orifice 326 and sonic nozzle 320 to supersonic chamber 322. The supply of steam at inlet ports 312 and 314 is maintained at about 450 psia to create 135 psia at exit 324 and minimize flow through the orifice. Nozzle 328 is operative to create a sonic shock wave and isolate the pressure of treatment chamber 330 from the pressure in chamber 322 (while isolation is also typical of nozzle 120 and nozzle 220 with their respective chambers). In the foregoing example, treatment pressure is about 405 psia in chamber 330.

In the downstream section, the steam goes through yet another nozzle 156 operative to re-accelerate the steam and create a low pressure region about exit port 158 where the steam returns to substantially ambient conditions as indicated at 357 on FIG. 3(*b*).

Yet another embodiment of the inventive apparatus and process is illustrated in connection with FIG. 4, wherein like parts are numbered 400 numerals higher than in FIG. 1.

Figure 4:
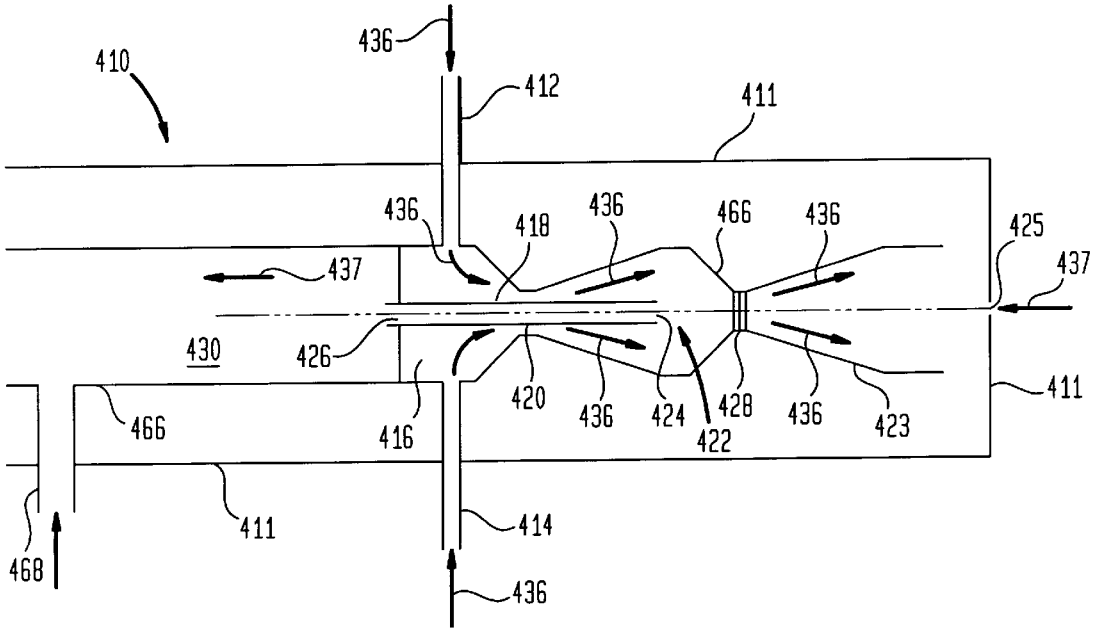
FIG. 4 is a schematic diagram illustrating the apparatus of the present invention as used for treating yarn at low pressure.

In FIG. 4 there is shown schematically a vapor treatment apparatus 410 for vapor treating articles of manufacture at sub-atmospheric conditions of pressure. There is shown an enclosure 411 having within it a subatmospheric treatment chamber 430 coupled to an expansion chamber 422 by way of a conduit 418 which has ports 424 and 426. Chamber 422 is coupled to plenum 416 by way of a first nozzle indicated at 420. A second nozzle, 428 couples chamber 422 with an exhaust tube 423. The various parts described above are defined by walls 466 and the various parts may be fabricated in portions as is the case with apparatus 10 and apparatus 110.

Apparatus 410 is operated by supplying steam at elevated pressure, that is above, ambient pressure, to inlets 412, 414 of plenum 416 as is shown. Steam flows as indicated by arrows 436 through plenum 416, expansion chamber 422 and exit tube 423. The flow is operative to create a region of low, preferably minimum pressure about port 424 and to create a sonic shock wave at 428 in order to isolate the pressure of chamber 422 from the exhaust tube.

Yarn is continuously fed through an orifice 425 in enclosure 411 in the direction indicated by arrow 437; of course other articles may be employed. The steam within enclosure 411 is slightly above atmospheric pressure, so that little steam escapes through orifice 425. Yarn passes upstream through the shock region at 428, into the high velocity, subatmospheric pressure region of chamber 422. The pressure within treatment chamber 430 is maintained at about the same subatmospheric level by subatmsopheric steam supply line 468, so that steam flow through conduit 418 is minimal and the treatment chamber is effectively isolated from atmospheric pressure. A similar, mirror image device of the type described above, can be provided downstream to isolate the other end of the chamber where the yarn exits low pressure treatment chamber 430.

The present invention has been illustrated and described in connection with numerous embodiments which are set forth as illustrative of the invention. Various modifications will be apparent to those of skill in the art, for example, the materials to be heated may be in the form of fibers, yarns, ropes, sheets, films, fabrics, or any other continuous stream of solid material. It may also include non-continuous materials (e.g. particulate or semi-solid) that can be carried through the treatment chamber on continuous belts. The invention is generally directed to a device for heating of materials by condensation of vapor onto the material at a combination of temperature and pressure corresponding to saturation of the vapor (e.g. steam, ethylene glycol, Dowtherm, etc.) as set forth above. The spirit and scope of the invention is defined by the following claims.

What is claimed is:

1. A method of heat-treating an article of manufacture comprising:

(a) supplying a heated vapor medium at elevated pressure through a first nozzle to a vapor expansion chamber, said nozzle being capable of cooperating with the expansion chamber to generate a high velocity flow in said chamber to establish regions of reduced pressure within said expansion chamber;

(b) continuously feeding said article of manufacture to said expansion chamber through a feed orifice located within a region of reduced pressure in said expansion chamber;

(c) conveying said article through a sonic shock region to a treatment chamber, said sonic shock region being operative to isolate the pressure of said treatment chamber from said expansion chamber.

2. The method according to claim 1, wherein said feed orifice is defined by a feed conduit and is located at about a point of minimum pressure within said expansion chamber, and wherein said feed conduit further defines an entrance thereto external to said expansion chamber.

3. The method according to claim 1, further comprising the step of providing a heated vapor medium through a second nozzle to said treatment chamber.

4. The method according to claim 1, wherein said article of manufacture is selected from the group consisting of fibers, fiber tow, film, fabric and yarns.

5. The method according to claim 4, wherein said article is a fiber tow.

6. The method according to claim 4, wherein said article is an article formed of polyethylene terephthalate.

7. The method according to claim 1, wherein said heated vapor medium is steam.

8. The method according to claim 7, wherein the steam is at saturation conditions in said treatment chamber.

9. The method according to claim 7, wherein the steam is substantially at saturation conditions as fed to said first nozzle.

10. The method according to claim 1, further comprising venting said heated vapor medium from said treatment chamber through a third nozzle.

11. A method of heat-treating an article of manufacture comprising:

(a) supplying a heated vapor medium at elevated pressure through a first nozzle to an expansion chamber to generate a region of low pressure therein;

(b) venting said vapor medium from said expansion chamber through a second nozzle operative to generate a shock region adapted to isolate the pressure in the expansion chamber from external pressure; and (c) conveying said article through said shock region and through said low pressure region of said expansion chamber through a feed orifice to a low pressure treatment chamber characterized by subambient pressures.

12. A self-sealing apparatus for vapor-treating continuously fed articles of manufacture comprising:

(a) means for providing a supply of a heated vapor medium at elevated pressure;

(b) a vapor expansion chamber;

(c) a first nozzle coupling said means for providing a supply of said heated vapor medium with said expansion chamber, said first nozzle being capable of cooperating with said expansion chamber to generate a high velocity flow of said vapor medium in said expansion chamber and to reduce the pressure of said vapor medium to a pressure minimum within said expansion chamber;

(d) a feed orifice, positioned, configured and dimensioned to introduce said articles of manufacture into said expansion chamber at a zone of reduced pressure of said vapor medium;

(e) means for defining a treatment chamber; and (f) a second nozzle coupling said expansion chamber and said treatment chamber, said second nozzle being capable of maintaining a sonic shock wave operative to isolate the pressure in said treatment chamber from the pressure in said expansion chamber.

13. An apparatus according to claim 12, further comprising a feed conduit having first and second ports, said first port defining said feed orifice and being positioned at about said pressure minimum within said expansion chamber, and said second port being external to said expansion chamber.

14. An apparatus according to claim 12, wherein said high velocity flow is a supersonic flow.

15. The apparatus according to claim 12, wherein said apparatus further comprises a second means for supplying a heated vapor medium coupled to said second nozzle.

16. The apparatus according to claim 12, further comprising a downstream sealing device comprising:

(g) a third nozzle;

(h) a sump coupled to said treatment chamber by way of said third nozzle; and (i) an exit port within said sump located at a zone of reduced pressure generated by said third nozzle.

17. The apparatus according to claim 16, wherein said third nozzle is capable of maintaining a sonic shock wave operative to isolate the pressure in said sump from the pressure in said treatment chamber.

18. The apparatus according to claim 16, wherein said third nozzle is capable of generating a pressure minimum within said sump and wherein said exit port is located at about said minimum.

19. The apparatus according to claim 12, wherein said apparatus is formed of stainless steel.

20. An apparatus for cascading the pressure in the vapor treatment of continuously fed articles of manufacture comprising:

(a) means for supplying a first supply of a heated vapor medium at elevated pressure;

(b) a first vapor expansion chamber;

(c) a first nozzle coupling said means for supplying said first supply of said heated vapor medium with said first expansion chamber, said first nozzle being capable of cooperating with said first expansion chamber to generate a supersonic flow of said vapor medium in said expansion chamber and generate a pressure minimum within said chamber;

(d) a first feed orifice positioned, configured and dimensioned to introduce said articles of manufacture into said first expansion chamber at a zone of reduced pressure;

(e) means for supplying a second supply of a heated vapor medium at elevated pressure;

(f) a second vapor expansion chamber;

(g) a second nozzle coupling said second supply of said heated vapor medium with said second vapor expansion chamber, said second nozzle being capable of cooperating with said second expansion chamber to generate a supersonic flow of said vapor medium within said second vapor expansion chamber and generate a pressure minimum within said second chamber;

(h) a second feed orifice positioned, configured and dimensioned to introduce said articles of manufacture into said second expansion chamber at a zone of reduced pressure;

(i) a third means for supplying of a heated vapor medium at an elevated pressure;

(j) a treatment chamber;

(k) a third nozzle coupling said third means for supplying a heated vapor medium to said treatment chamber, said third nozzle being capable of maintaining a sonic shock wave operative to isolate the pressure of said treatment chamber from said second vapor expansion chamber; and (l) a third feed orifice for introducing said articles into said treatment chamber.

* * * * *